US006357059B1

(12) United States Patent
Lau

(10) Patent No.: US 6,357,059 B1
(45) Date of Patent: Mar. 19, 2002

(54) PORTABLE SPA

(75) Inventor: Vincent Wai Shun Lau, Hong Kong (HK)

(73) Assignee: Pleasure Time Products (HK) Limited, Hong Kong (HK)

( * ) Notice: Subject to any disclaimer, the term of this patent is extended or adjusted under 35 U.S.C. 154(b) by 0 days.

(21) Appl. No.: 09/536,572

(22) Filed: Mar. 28, 2000

(51) Int. Cl.[7] ..... A47K 3/00
(52) U.S. Cl. ..... 4/541.1; 4/506
(58) Field of Search ..... 4/541.1–541.5, 4/506

(56) References Cited

U.S. PATENT DOCUMENTS 4,535,490 A * 8/1985 Wright ..... 4/541.5
4,546,505 A * 10/1985 Wakenshaw ..... 4/541.3
4,773,104 A * 9/1988 Wang ..... 4/492
4,893,362 A * 1/1990 Murphy ..... 4/493
4,975,992 A * 12/1990 Patterson et al. ..... 4/599
5,862,543 A * 1/1999 Reynoso et al. ..... 4/541.6

* cited by examiner

*Primary Examiner*—Charles E. Phillips
(74) *Attorney, Agent, or Firm*—Raymond Sun

(57) ABSTRACT

A spa pool has an enclosing wall that has at least one inflatable chamber, and a plumbing system retained in the interior of the wall. The plumbing system includes a plurality of jet nozzles, and a plurality of hoses that couple the plurality of jet nozzles. The wall can have two openings that communicate the interior with the exterior of the spa pool, the two openings including a first opening coupled to an inlet for receiving water into the interior from a pump, and a second opening coupled to an outlet for delivering water from the interior to a pump.

12 Claims, 13 Drawing Sheets

PORTABLE SPA

BACKGROUND OF THE INVENTION

1. Field of the Invention

The present invention relates to portable pools, and in particular, to a portable spa pool that can be conveniently moved from one location to another, and which can be conveniently and quickly installed and disassembled.

2. Description of the Prior Art

Spa pools have become increasingly popular as people have come to recognize and enjoy the relaxing and healthy benefits accorded by a good invigorating soak in a spa pool or tub. Most conventional spa pools are provided in the form of a spa tub in a bathroom or a health club, or in the form of an outdoor spa. Each of these spa pools has a jet nozzle system that must be powered by a pump and its associated plumbing. Some spa pools are also provided with a heater that works in conjunction with the pump to heat the water that is re-circulated in the spa pool.

Unfortunately, in order to move a conventional spa pool to a different location, the entire spa pool and its accompanying jet nozzle system, pump, plumbing and heater must be completely dis-assembled and moved. Such dis-assembly can be quite complex, and often requires the expertise of a plumber. Even if a normal user is able to accomplish the dis-assembly on his or her own, such disassembly is very time-consuming and difficult, and any subsequent re-assembly will be equally time-consuming and challenging. In other words, conventional spa pools tend to stay fixed in their original locations, and are unlikely to be moved to a different location.

Such lack of portability is a significant drawback, since nowadays people are more mobile and often enjoy travelling and moving about. It would be desirable if they could also enjoy the luxury and benefit of the spa pool at different locales while not experiencing the inconveniences and difficulties associated with having to assemble and dis-assemble a conventional spa pool. This would encourage and promote increased use of spa pools.

Another drawback associated with conventional spa pools is that the plumbing systems are typically provided outside the pool. Unfortunately, conventional plumbing systems are quite susceptible to leaks (e.g., at the hose connections with the jet nozzles), which makes it less desirable to use such conventional spa pools inside the house.

Thus, there remains a need for a portable spa pool that overcomes the problems associated with the conventional spa pools, which minimizes leaks, which can be installed and dis-assembled for storage in a quick and convenient manner, and which can be packed and moved about conveniently.

SUMMARY OF THE DISCLOSURE

It is an objective of the present invention to provide a portable spa pool which can be installed and dis-assembled for storage in a quick and convenient manner, and which can be packed and moved about conveniently.

It is another objective of the present invention to provide a portable spa pool which minimizes leakage of water that is contained inside the spa pool.

The objectives of the present invention are accomplished by providing a spa pool having an enclosing wall that has at least one inflatable chamber, and a plumbing system retained in the interior of the wall. The plumbing system includes a plurality of jet nozzles, and a plurality of hoses that couple the plurality of jet nozzles. The wall can have two openings that communicate the interior with the exterior of the spa pool, the two openings including a first opening coupled to an inlet for receiving water into the interior from a pump, and a second opening coupled to an outlet for delivering water from the interior to a pump.

In one embodiment of the present invention, a liner can be provided to overlie the enclosing wall, and a cover can be provided to overlie the liner and enclosing wall. In another embodiment of the present invention, a pump can be coupled to the interior of the pool, and a heater coupled to the pump for heating water that passes through the pump. A case can also be provided for holding the enclosing wall, the jet nozzles, the hoses, the pump and the heater.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a spa pool that can be easily and quickly assembled and dis-assembled without the need for any special tools. The spa pool of the present invention provides a plumbing system that requires the use of only two openings in the pool, thereby minimizing the potential for water leakage. The potential for water leakage is further minimized by providing the plumbing system inside the spa pool. In addition, the present invention provides a compact storage case that can be used to house the pump, heater, and the components of the dis-assembled spa pool so that the spa pool can be conveniently moved from one location to another. Other benefits and features will be described in connection with the spa pool hereinbelow.

Figure 1:
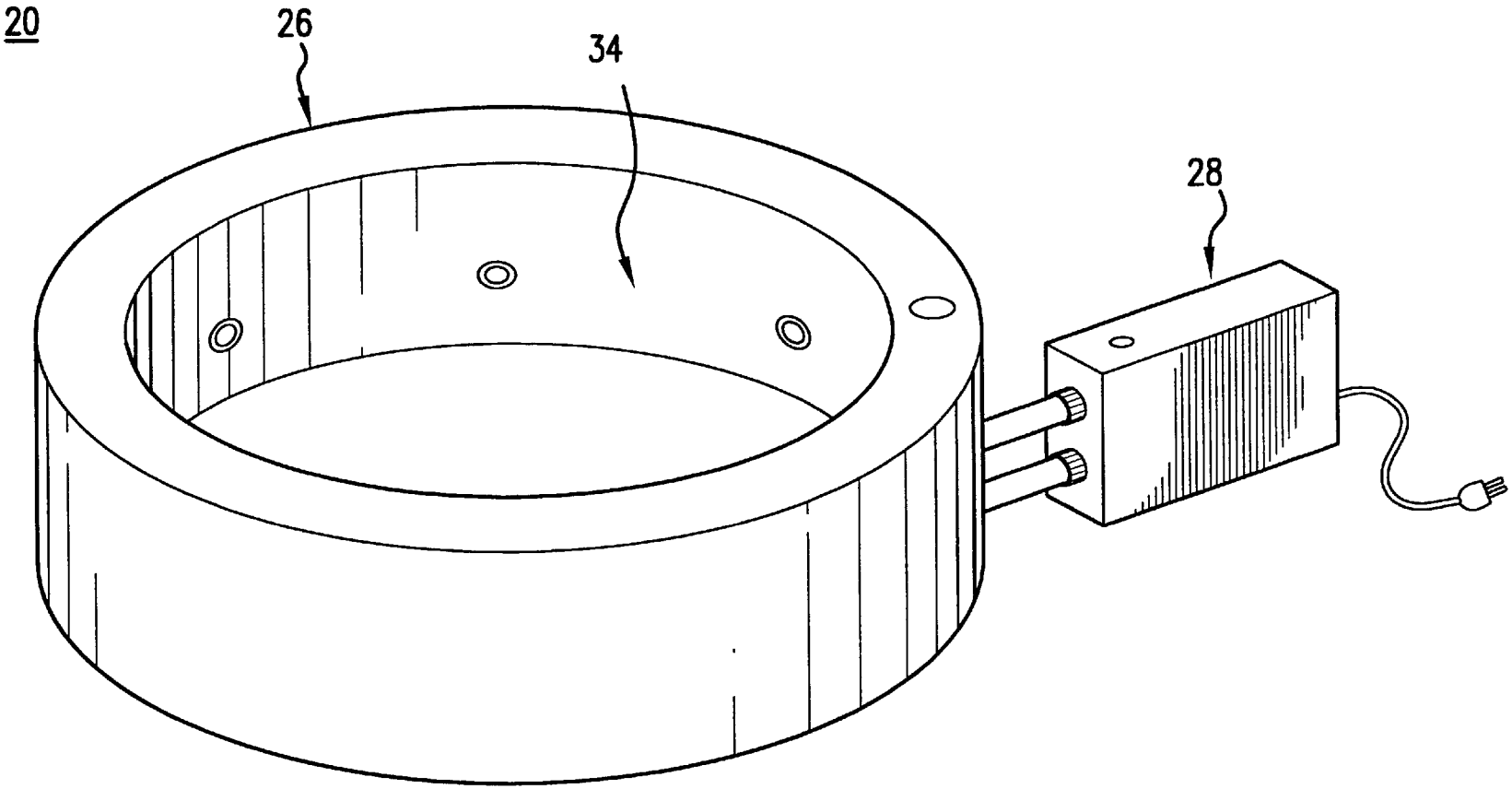
FIG. 1 is a perspective view of a portable spa pool according to one embodiment of the present invention.
Figure 2:
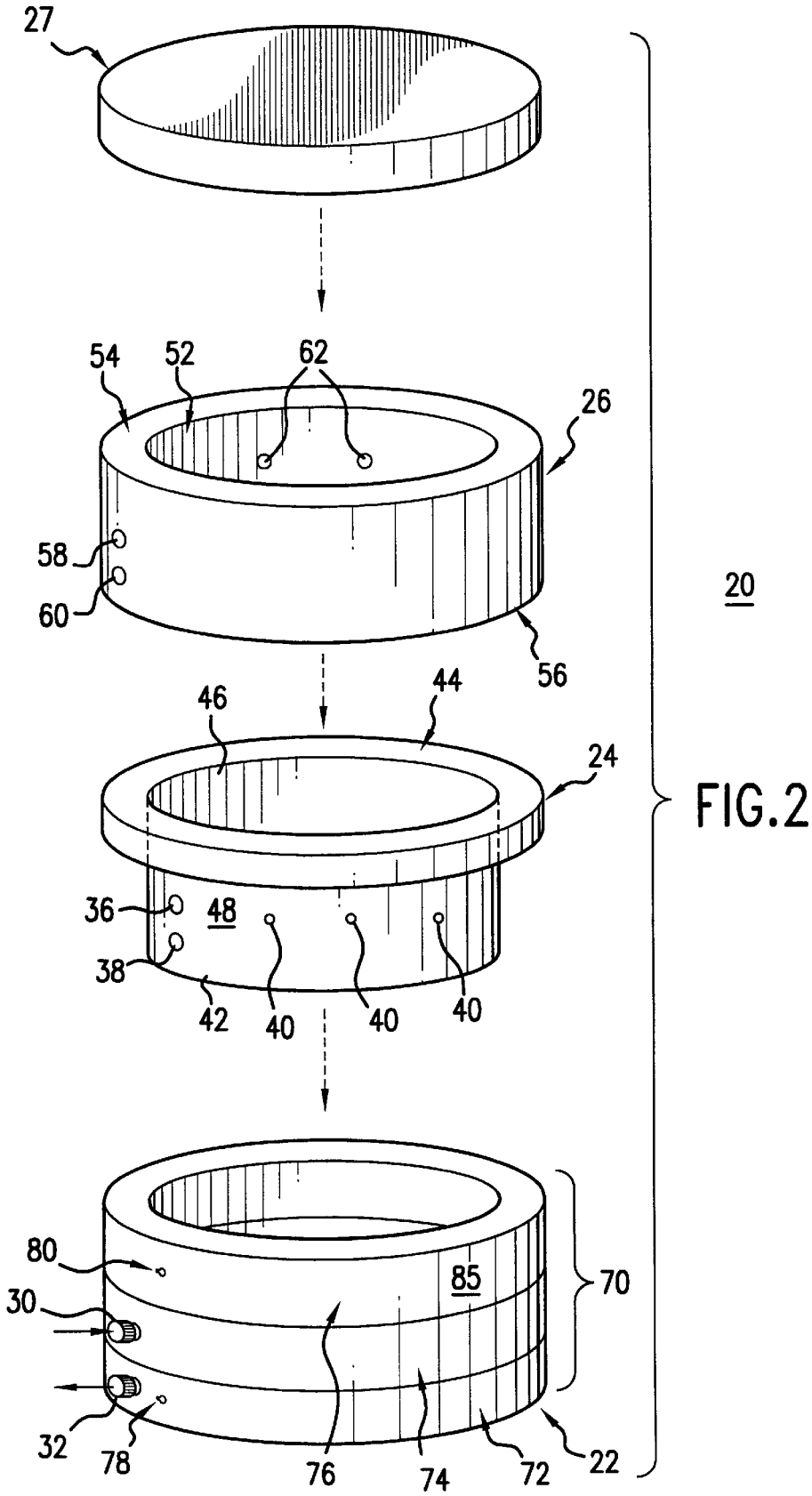
FIG. 2 is an exploded perspective view of the spa pool of FIG. 1.

Referring to FIGS. 1 and 2, the present invention provides a portable spa pool assembly 20 that has a pool 22, a liner 24 that covers the internal walls of the pool 22, and a cover 26 (e.g., such as a nylon cover) that can be used to overlay the liner 24 and the pool 22. The pool 22 is shown in greater detail in FIGS. 2–4, and is coupled to a pump and heater unit 28 via a water inlet 30 and a water outlet 32. The water inlet 30 and the water outlet 32 are the only two openings provided in the walls of the pool 22 that communicate with the water-containing interior 34 of the pool 22.

The liner 24 has a generally circular container portion 42 that is adapted to receive water, and an annular fold-over flange or collar 44 provided along the top annular edge 46 of the container portion 42. The liner 24 has two openings 36 and 38 that are provided in the wall 48 of the container portion 42 and aligned with the water inlet 30 and the water outlet 32, respectively. In addition, a plurality of openings 40 are spaced apart about the wall 48, with each opening 40 aligned with one nozzle of the jet nozzle system described below. The liner 24 is preferably made from a material that is water-impervious and which is capable of tolerating heat and cold. Non-limiting examples of the material can include PVC, rubber, nylon, PU lamination, and polyethylene. The liner 24 also acts as a water-containing layer of material that protects against water leakage, and to protect the pool 22 itself from puncture or other damage. Cold-crack additives (i.e., cold weather proofing) and other additives can be coated or added to the liner 24 to improve the durability of the liner 24.

Figure 3:
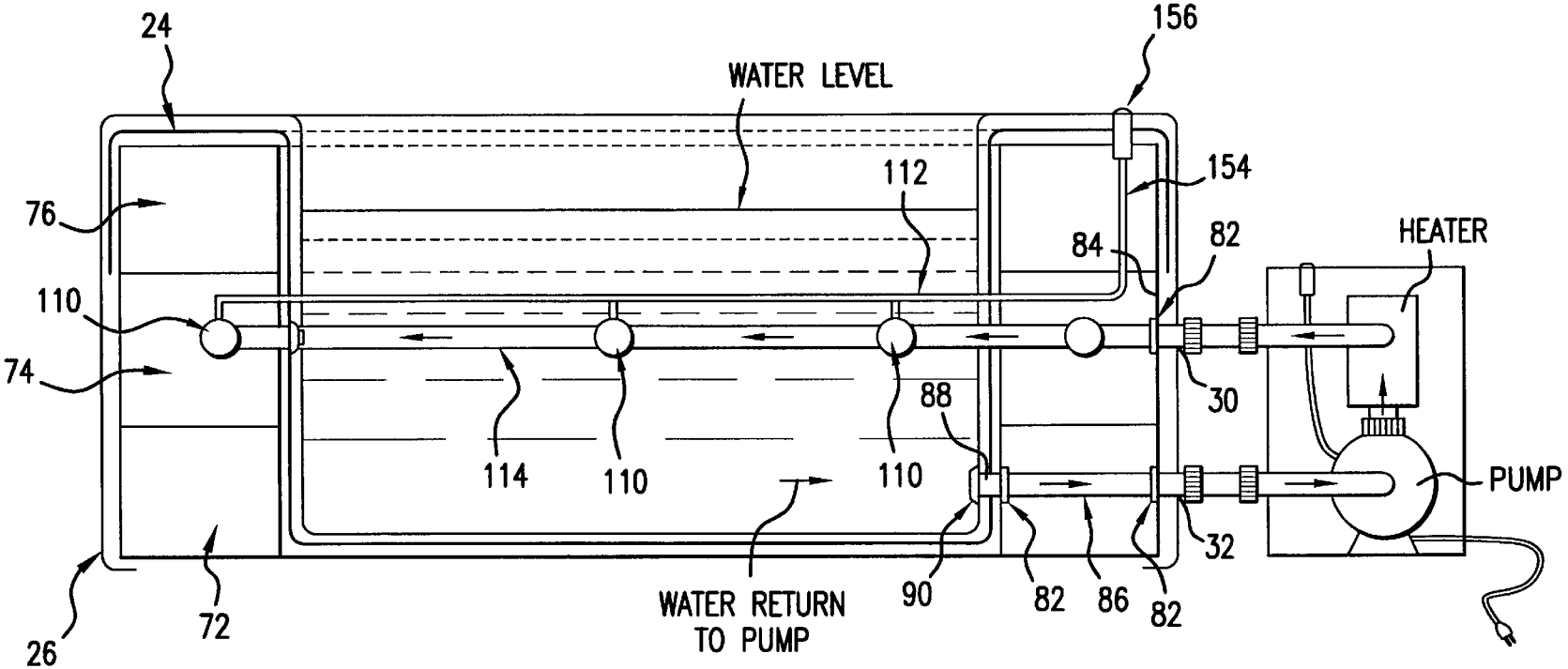
FIG. 3 is a cross-sectional view of the spa pool of FIG. 1.
Figure 4:
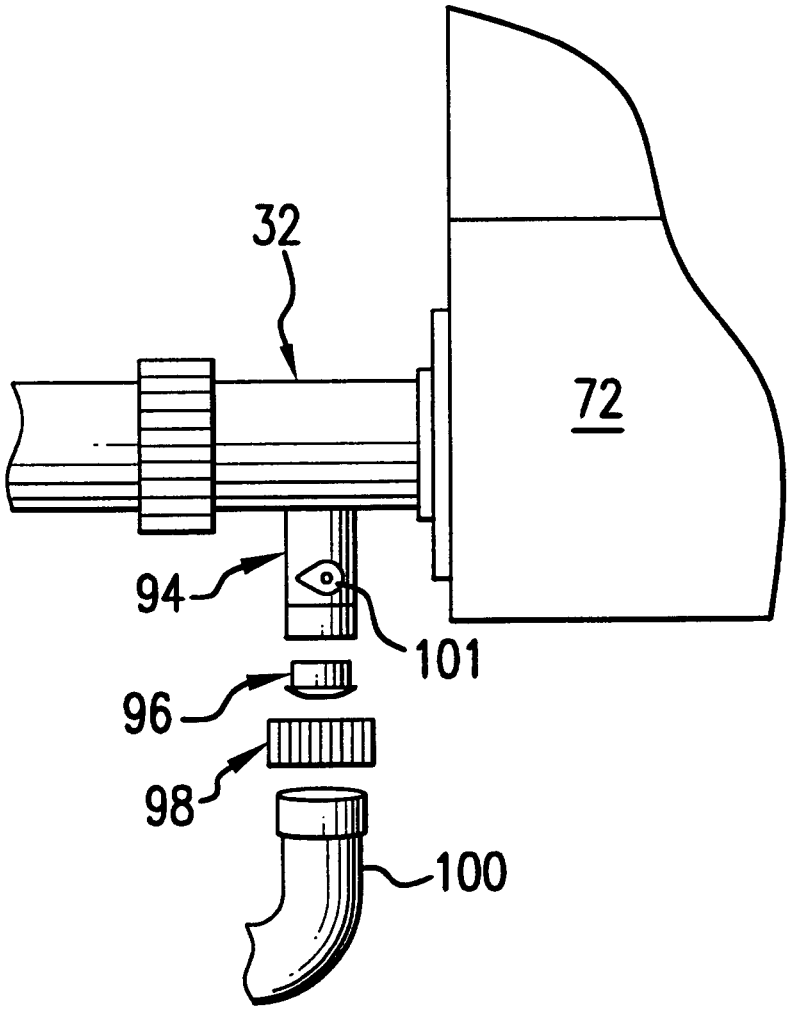
FIG. 4 is an enlarged sectional view of the water outlet of the spa pool of FIG. 3.

The cover 26 is sized and configured similarly as the liner 24, and has an inner layer 52 that overlies the container portion 42 of the liner 24, an annular lip portion 54 that overlies the collar 44, and an annular outer layer 56 that overlies the outer periphery of the collar 44 and the pool 22. The cover 26 has two openings 58 and 60 that are provided through the inner layer 52 and the outer layer 56, and are aligned with the water inlet 30 and the water outlet 32, respectively. In addition, a plurality of openings 62 are spaced apart about the inner layer 52, with each opening 62 aligned with an opening 40 of the liner 24, and one nozzle of the jet nozzle system described below. The cover 26 can perform two functions. First, the surfaces of the layers 52 and 56 can be provided with decorated designs to provide an aesthetically pleasing surface cover to hide the internal components of the portable spa pool assembly 20. Second, the cover 26 can provide an additional layer of protection for the pool 22 itself to prevent puncture or other damage to the pool 22 and the liner 24, and to protect against water leakage. The cover 26 can be made from a material that is waterproof, mold-resistant, washable and which provides a good texture or feel (since the user would be sitting on the cover 26). Non-limiting examples of these materials include a nylon with a polyurethane coating that waterproofs the nylon, or a fabric. In addition, an outer cover 27 can be provided to completely insulate and cover the interior 34 of the pool 22. For example, the outer cover 27 can prevent heat loss due to air convection when the pool 22 is being heated up for use. The outer cover 27 also serves as a winter or outdoor protective cover, and can be helpful in preventing children from inadvertently falling into the pool 22. Referring now to FIGS. 2–4, the pool 22 has an annular side wall 70 that defines the interior of the pool 22 and supports the liner 24. The annular side wall 70 has three separate sections, a first or lower inflatable air chamber 72, a non-inflatable central groove section 74, and a second or upper inflatable air chamber 76. The air chambers 72 and 76 are inflatable to define the shape of the spa pool 22 when fully inflated, and can be made from any of the materials described above for the liner 24 and the cover 26. In one embdiment of the present invention, the air chambers 72 and 76 are made of a heat and chlorine resistant polyvinylchloride (PVC) material. The central groove section 74 is defined by (i.e., between) the two air chambers 72 and 76, and is essentially an annular groove in which the components (e.g., the jet nozzles, hoses, etc.) of the plumbing system are retained. The central groove section 74 can be made from a material (e.g., PVC) that provides sufficient strength and rigidity to separate and support the two air chambers 72 and 76. In one embodiment, the air chambers 72, 76 and the central groove section 74 can be made from the same material, PVC. The air chambers 72 and 76 have valves 78 and 80, respectively, through which air can be introduced to inflate the chambers 72 and 76.

Referring to FIG. 3, the water inlet 30 is a short tubing that extends through the central groove section 74 to communicate with the interior 34 of the pool 22. A gasket 82 is provided over the inlet 30 adjacent the inner wall 84 of the central groove section 74. In addition, the water outlet 32 includes a tubing or pipe 86 that can be made, for example, from a hard material such as PVC. The outer end of the pipe 86 communicates with the water outlet 32, and the inner end of the pipe 86 communicates with the interior 34 of the pool 22 via an opening 88. One gasket 82 can be provided over the outer end of the pipe 86 in the interior of the air chamber 72 adjacent the water outlet 32, and another gasket 82 can be provided over the inner end of the pipe 86 in the interior of the air chamber 72 adjacent the opening 88. A strainer 90 can be positioned in front of the opening 88 inside the interior 34 to collect or filter debris and other particles to prevent these particles from being transported to the pump and heater unit 28. The gaskets 82 can be any conventional gasket, or can be the novel gasket 82 described hereinbelow in connection with FIG. 14. The gaskets 82 function to provide a tight seal against water leakage from the interior 34 of the pool 22. The fact that the water inlet 30 and the water outlet 32 are the only two openings which communicate the interior 34 to the outside, coupled with the provision of the novel and effective gaskets 82, further minimize against the possibility of water leakage. This is to be contrasted with conventional spa pools that provide more than two such openings which communicate the interior of the spa pool to the outside. Such conventional spa pools often experience annoying water leakages from these numerous openings.

Referring to FIG. 4, which is an enlarged view of the water outlet 32, a drain cock assembly is provided to allow water to be drained from the interior 34. The drain cock assembly has a drain cock 94 that extends from the tubing of the water outlet 32, a stopper 96 that is fitted at the end of the drain cock 94, and a cap 98 that can be threadably screwed over the drain cock 94 to seal it. To drain water from the interior 34, the cap 98 and stopper 96 can be removed, and a hose 100 threadably screwed to the drain cock 94 to divert the water to the desired disposal destination. The hose

100 does not need to be used when the spa pool assembly 20 is used outdoors, since the water can be drained directly from the drain cock 94. However, if the spa pool assembly 20 is used indoors, the hose 100 can be coupled to the drain cock 94 and directed outside the house to drain the water from the spa pool 22. An on/off valve control 101 can be provided on drain cock 94, with an on/off ball valve (not shown) provided inside the drain cock 94. The control 101 allows the user to turn off the valve when dis-connecting the hose 100 (i.e., water to be diverted into the pool 22), and to turn on the valve when the hose 100 is connected (i.e., water to be drained).

Figure 5:
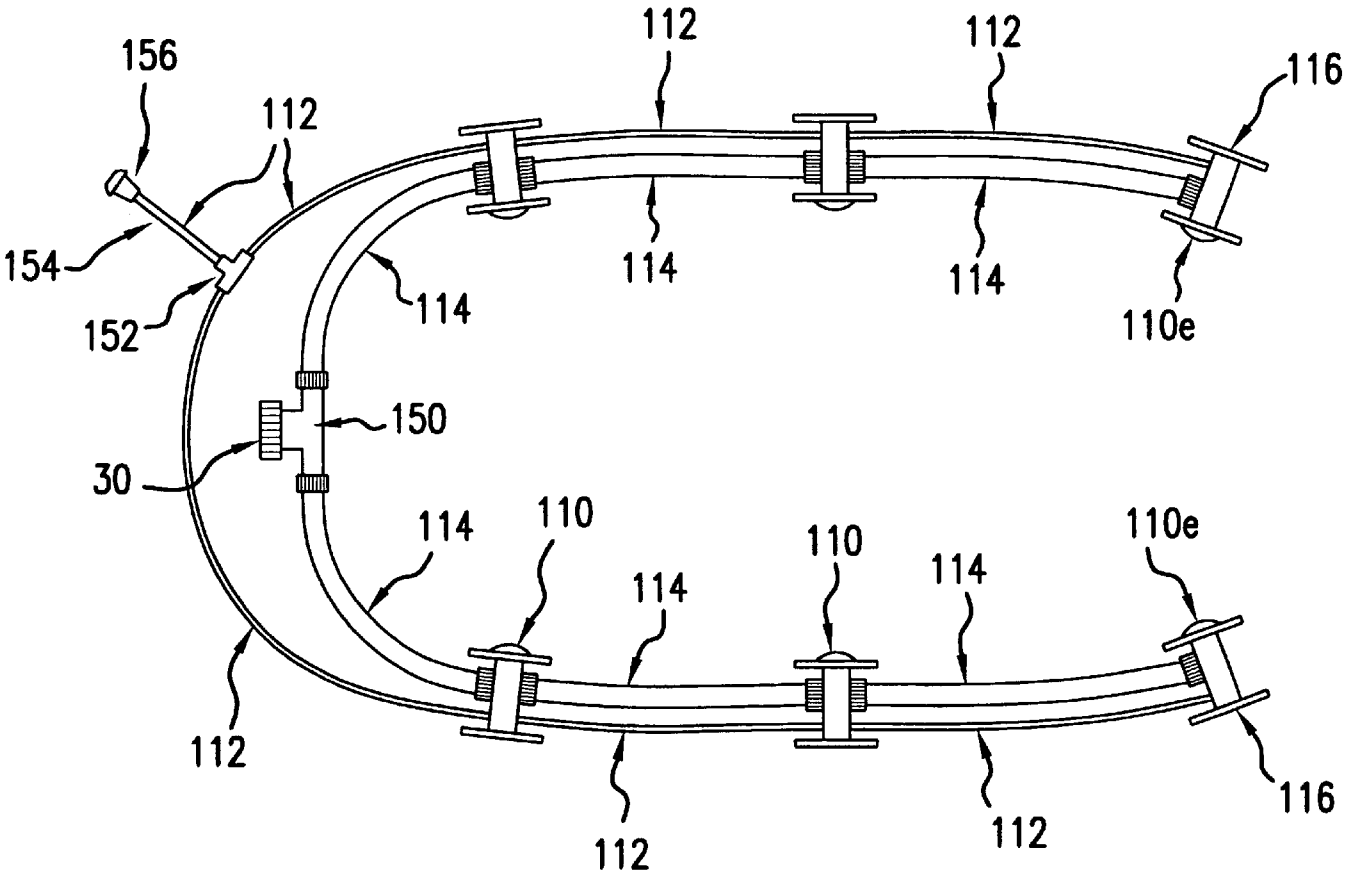
FIG. 5 is a plan view of the components of the plumbing system of the spa pool of FIG. 1 in an opened configuration.
Figure 6:
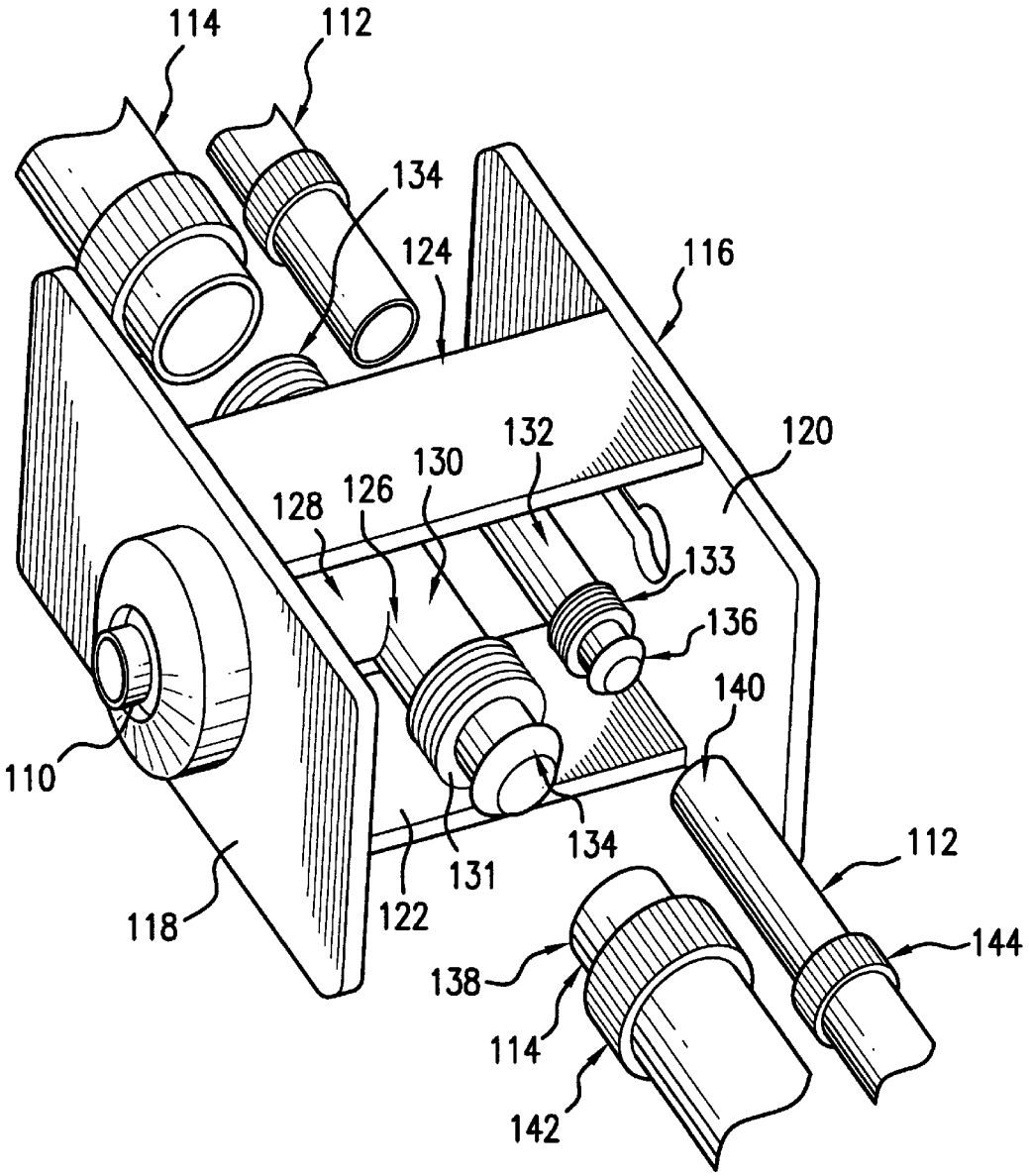
FIG. 6 is an exploded front perspective view of a jet nozzle housing of the spa pool of FIG. 1.

The plumbing system is illustrated in greater detail in FIGS. 3, 5 and 6. The plumbing system includes a plurality of jet nozzles 110, and a plurality of air hoses 112 and water hoses 114 that interconnect the jet nozzles 110 in the manner illustrated in FIG. 5 to extend annularly around the pool 22. Each hose 112, 114 can be made from the same material, such as PVC, and can have weaved nylon reinforcements laminated into the hose itself. Alternatively, the materials for the hoses 112, 114 can be different. For example, the water hoses 114 can be provided in the form of pipes that are made of hard PVC, metal or other hard materials. The hoses 112, 114 should preferably be able to withstand high water pressure and heat. The assembly of hoses 112, 114 and jet nozzles 110 shown in FIG. 5 is intended to be retained inside the central groove section 74. Each jet nozzle 110 is retained in a nozzle housing 116. Each jet nozzle 110 can be any conventional jet nozzle that is currently available and used for conventional spa pools. For example, two types of jet nozzles 110 can be used: a water flow adjustable nozzle and a non-adjustable nozzle. The jet nozzles 110 can also be one-directional, or multi-directional that are adjustable by the user to massage different areas of the user's back.

Figure 7:
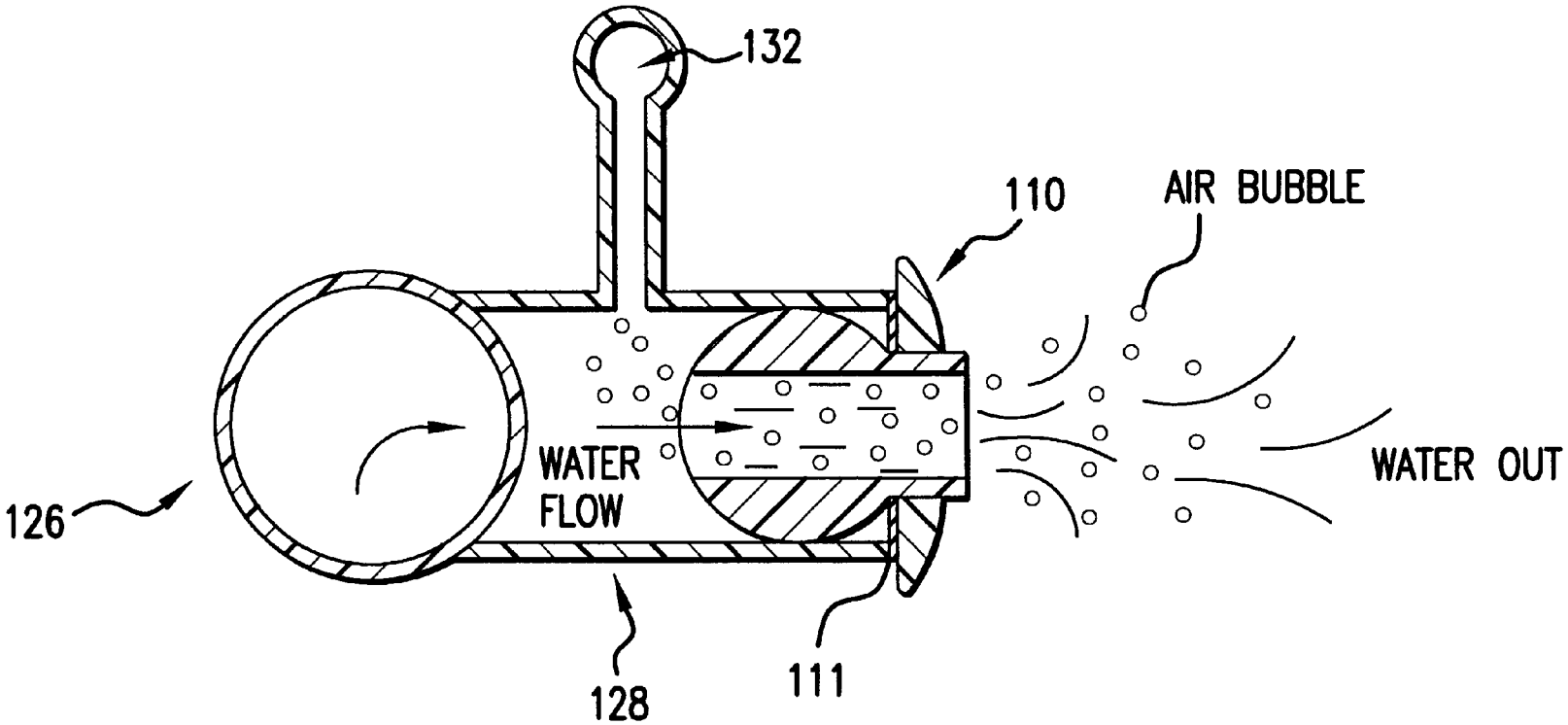
FIG. 7 is a cross-sectional view of the jet nozzle housing of FIG. 6.

Referring to FIGS. 5–7, the nozzle housing 116 has two side plates 118, 120 that are separated by two parallel plates 122, 124. The nozzle housing 116 can be designed to withstand 200 pounds compression pressure, just in case someone sits or stands on an individual housing 116. The side plates 118, 120 can also be contoured to fit snugly inside the central groove section 74. A T-connector 126 is retained (e.g., by rivets, snap-fit, glue or screws) inside the space defined by the plates 118, 120 and the plates 122, 124. The T-connector 126 has a central tubing 128 that is connected to the jet nozzle 110. A water-tight gasket 111 is provided between the central tubing 128 and the jet nozzle 110 to prevent water from leaking into the pool 22 from the nozzle housing 116. The T-connector 126 has two branch water tubings 130 that extend in opposite directions from the central tubing 128, and two branch air tubings 132 that also extend in opposite directions from the central tubing 128. Each branch tubing 130 and 132 has a threaded flange 131 and 133, respectively, and a flanged connector 134 and 136, respectively, at its end, that is adapted to receive and connect an end 138 and 140, respectively, of a water hose 114 and an air hose 112, respectively. As best shown in FIG. 6, each end 138 and 140 of the water hose 114 and an air hose 112, respectively, has a lock nut 142 and 144, respectively. To achieve the connection of the hoses 112, 114, each end 138 and 140 is slid over the flanged connector 134 and 136, respectively. The flange of the connectors 134, 136 provides an enlarged surface to snugly engage the ends 138, 140. Then, the lock nuts 142 and 144 can be slid over the hoses 114 and 112, respectively, and over the flanged connectors 134 and 136, respectively, to threadably engage the threaded flanges 131 and 133, respectively. This threaded engagement of the lock nuts 142 and 144 with the threaded flanges 131 and 133 provides an additional securing mechanism to prevent leakage.

Figure 8:
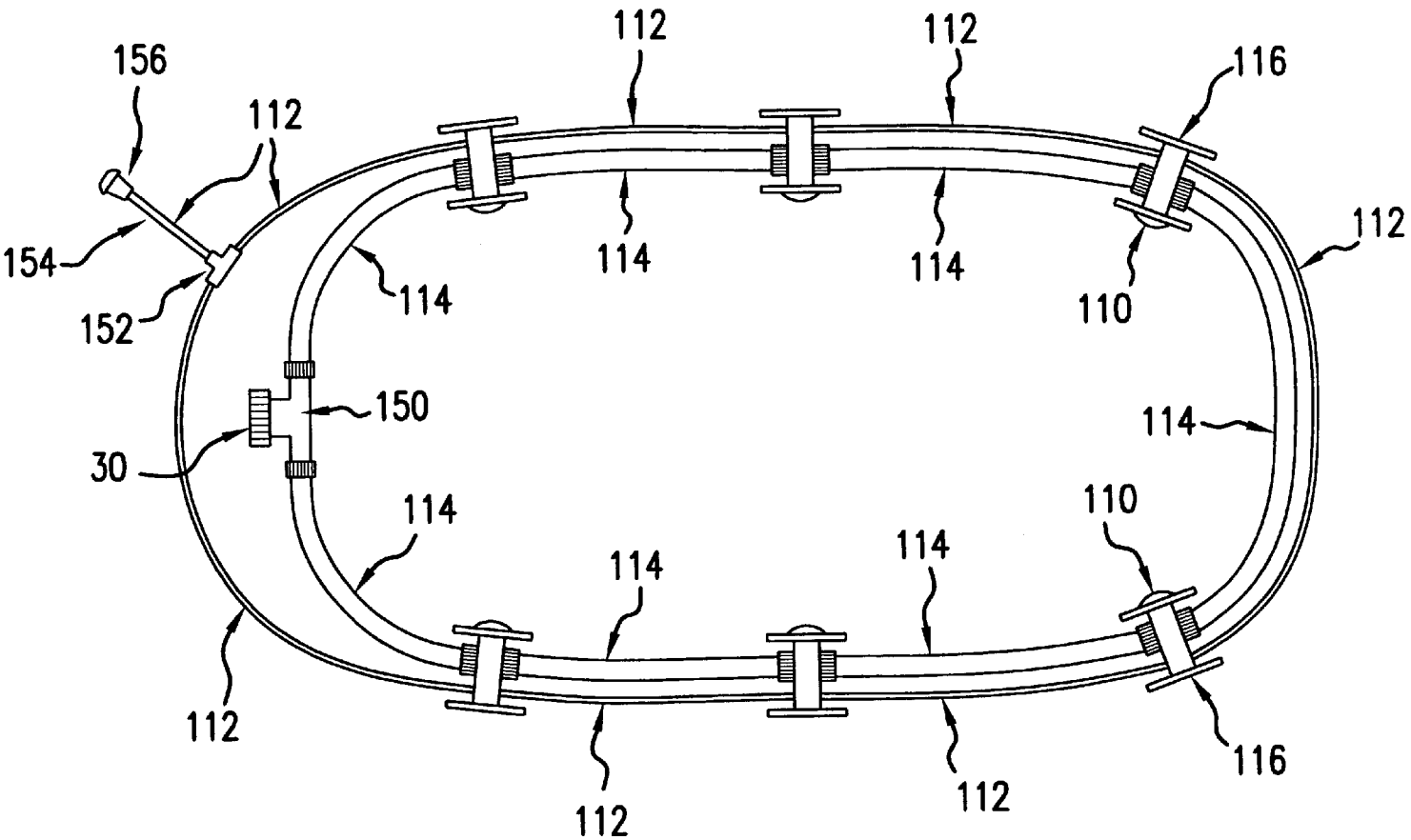
FIG. 8 is a plan view of the components of the plumbing system of the spa pool of FIG. 1 in a closed configuration.

Referring back to FIG. 5, the jet nozzles 110 can be spaced apart in an annular and opened configuration. A T-connector 150 can be provided at the location of the water inlet 30 to connect two adjacent water hoses 114. Similarly, another T-connector 152 can be provided to connect two adjacent air hoses 112 with a tubing 154 that extends through the second air chamber 76 to an air control 156. Screw-in plugs or two-way T-connectors can be used to seal the two end or terminal nozzles 110*e* to prevent water and air from leaking out. The jet nozzles 110 can also be spaced apart in an annular and closed configuration as illustrated in FIG. 8.

Figure 9:
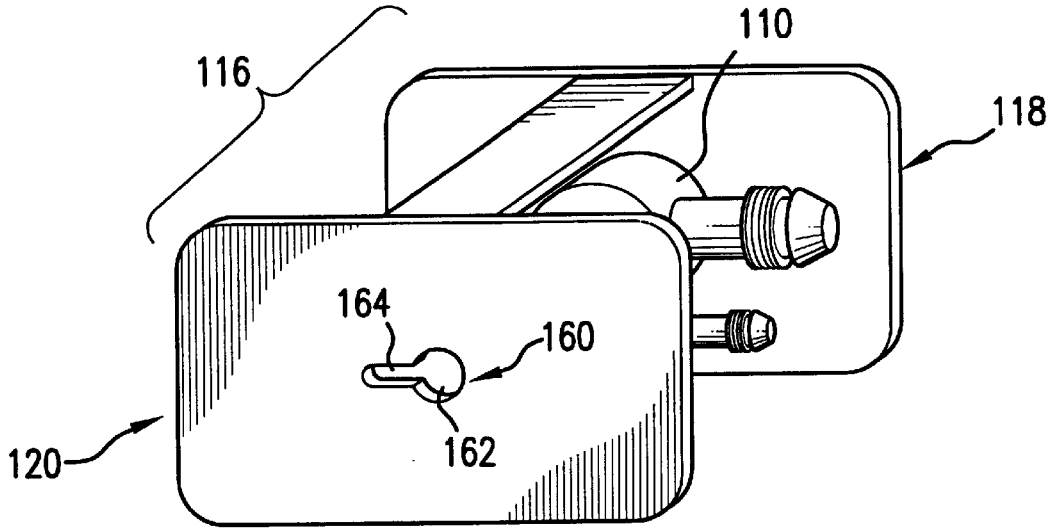
FIG. 9 is a rear perspective view of the jet nozzle housing of FIG. 6.
Figure 10:
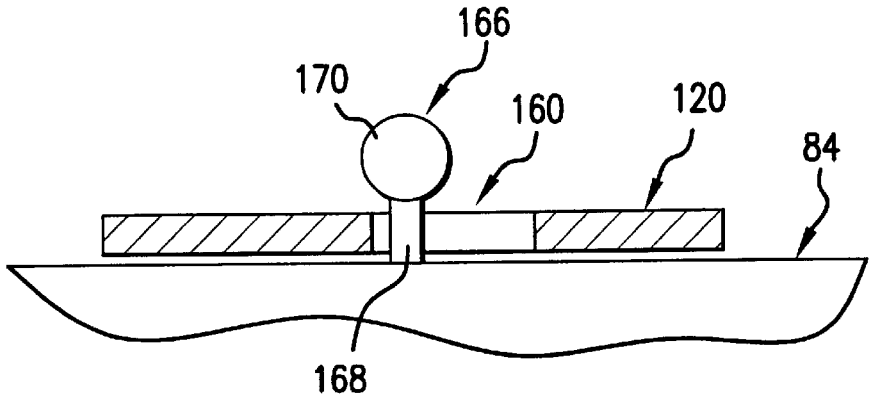
FIG. 10 is a top plan cross-sectional view illustrating one possible method of connecting the jet nozzle housing to the wall of the pool.

FIGS. 9 and 10 illustrate one non-limiting method of attaching each jet nozzle housing 116 to the inner wall 84 of the central groove section 74. The rear plate 120 of the housing 116 can be provided with a key-shaped opening 160 having a generally circular sub-opening 162 and a smaller elongated sub-opening 164. A plurality of connectors 166 can be provided in spaced-apart manner around the inner wall 84. Each connector 166 is adapted to connect one jet nozzle housing 116, and includes a thin shaft 168 and an enlarged or bulbous end 170. To achieve the connection, the bulbous end 170 is inserted through the circular sub-opening 162, and then the connector 166 slid with respect to the rear plate 120 in a manner so that the shaft 168 is received inside the elongated sub-opening 164. When the shaft 168 is retained inside the elongated sub-opening 164, the bulbous end 170 cannot be removed because it is larger than the elongated sub-opening 164, thereby creating the connection. To remove the jet nozzle housing 116 from the connector 166, the connector 166 is slid with respect to the rear plate 120 in a manner so that the shaft 168 is moved back into the circular sub-opening 162, where the bulbous end 170 can be removed from the key slot opening 160.

Although FIGS. 9 and 10 illustrate one method of attaching each jet nozzle housing 116 to the inner wall 84 of the central groove section 74, other similar connection schemes can be used to achieve the same connection. For example, any male-type connector (such as connector 166) can be provided in a spaced-apart manner about the annular inner wall 84, and releasably connect any opening or other female-type receptor provided in the rear plate 120 or any other part of the housing 116.

Figure 11A:
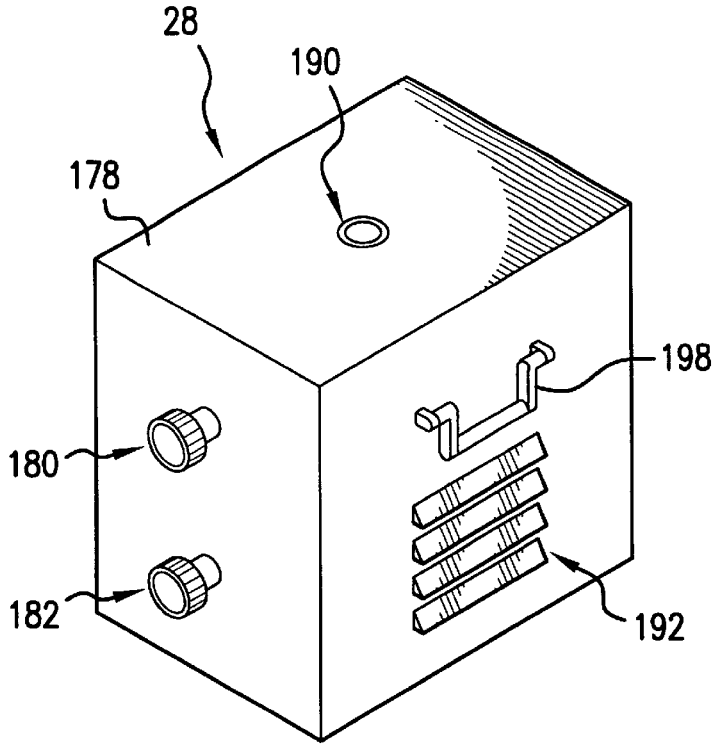
FIG. 11A is a front perspective view of a pump and heater unit for the spa pool of FIG. 1.
Figure 11B:
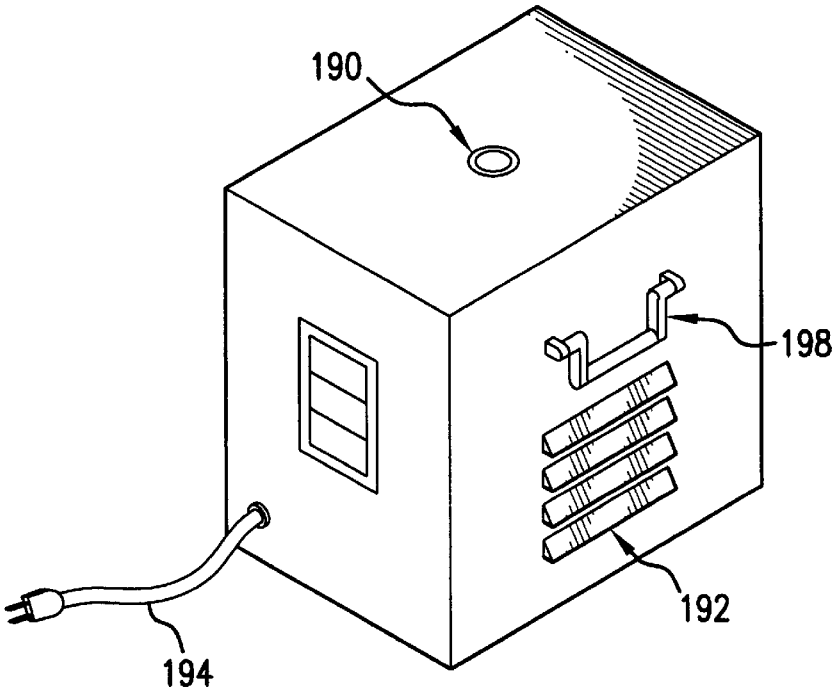
FIG. 11B is a rear perspective view of the pump and heater unit of FIG. 11A.
Figure 12:
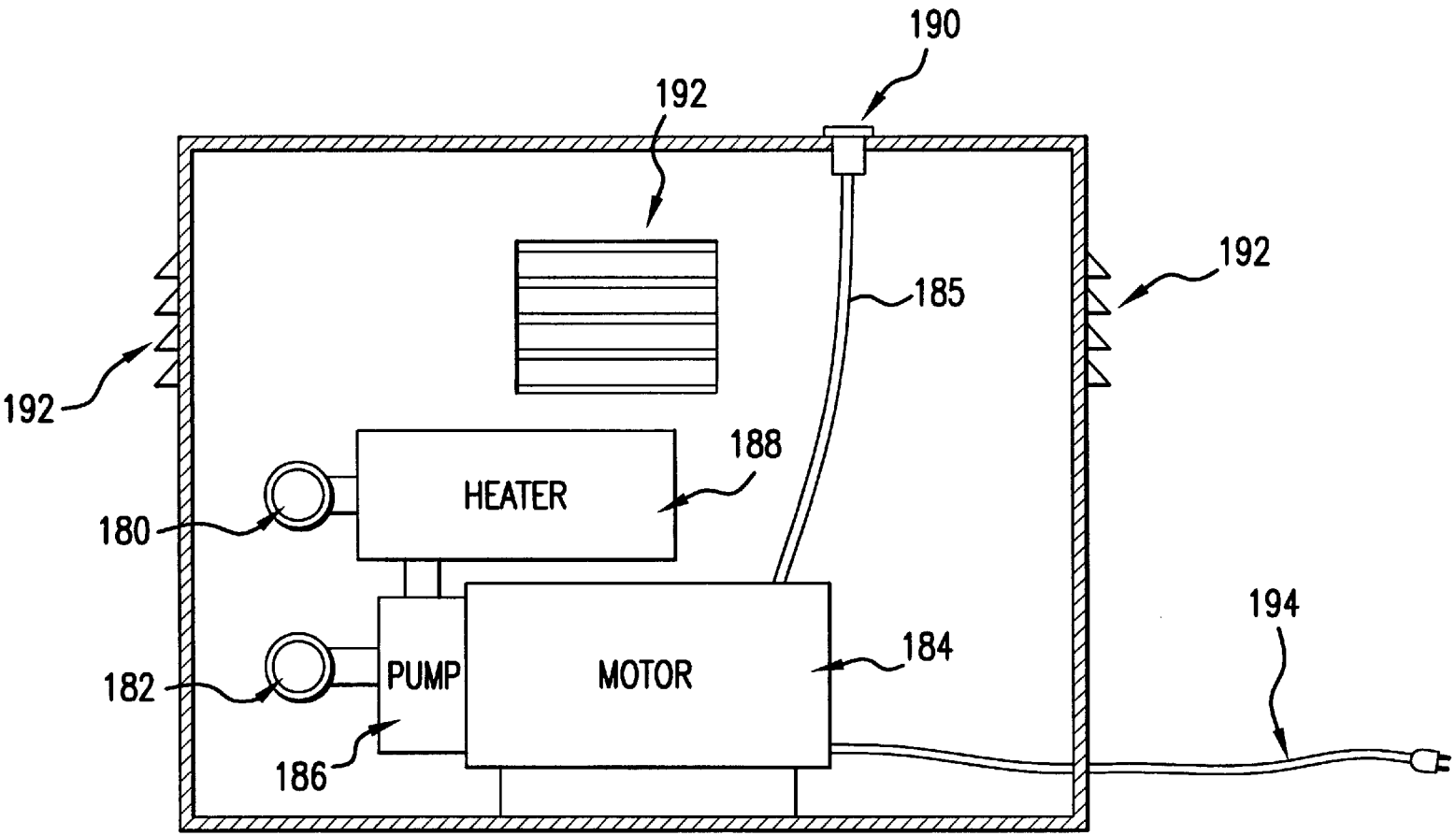
FIG. 12 is a cross-sectional view of the pump and heater unit of FIG. 11.

FIGS. 11 and 12 illustrate the pump and heater unit 28 in greater detail. The unit 28 has a casing 178, with a water outlet 180 that is adapted to be connected to the water inlet 30, and a water inlet 182 that is adapted to be connected to the water outlet 32. The casing 178 houses a motor 184, a pump 186 mounted on and controlled by the motor 184, and a heater 188. The heater 188 can be automatically activated by a water pressure sensor (built into the heater) which turns on the heater 188 when water begins to travel through it. The heater 188 can also be provided with an automatic maximum temperature cut-off if the water reaches a pre-selected maximum temperature (e.g., 104 degrees Fahrenheit). An air button 190 extends from outside the casing 178 and is coupled to the motor 184 via a vacuum tube 185. The air button 190 functions to turn on the heater 188 and the pump 186 (by operating the motor 184), and is used to provide additional safety to the user because the user is not exposed to any electrical components when turning on and off the pump 186. One or more grills 192 are provided on the casing 178 to function as a vent for allowing cool air to enter the casing 178 to cool the motor 184, pump 186 and heater 188. In addition, a cooling fan (not shown) can be mounted in the rear of the casing 178 to cool the motor 184, pump 186 and heater 188. A power cord 194 extends from the motor 184 through the casing 178. Handles 198 can be provided on the casing 178 to allow the user to lift and carry the unit 28. As one non-limiting example, the unit 28 can be embodied in the form of the PS-1 System marketed by Spa Builders System Group.

In operation, water from the water outlet 32 of the pool 22 enters from the inlet 182 and is pumped by the pump 186 through the heater 188 and then out through the outlet 180 to be delivered via the water inlet 30 of the pool 22 to the interior 34 of the pool 22.

Figure 13:
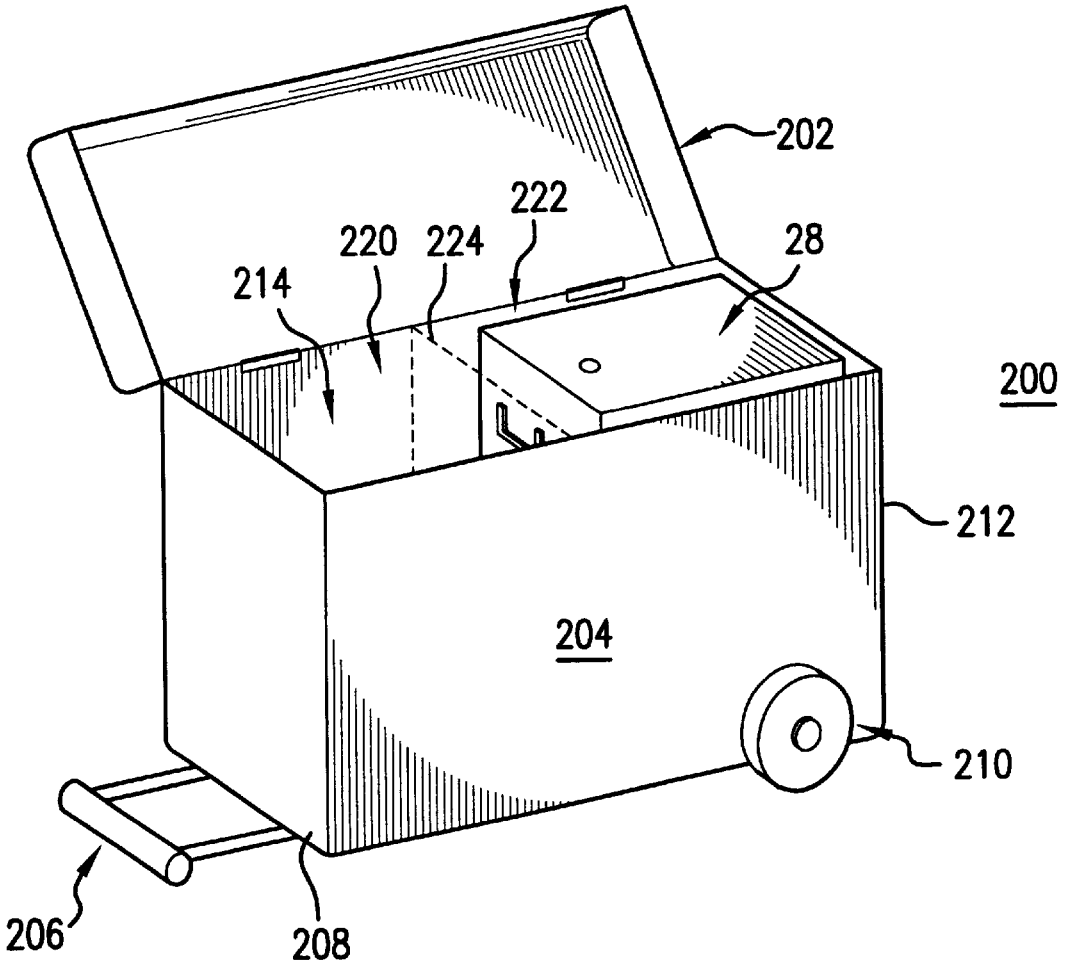
FIG. 13 illustrates a carrying case that can be used to store all the components of the spa pool assembly of FIG. 1.

Referring to FIG. 13, a carrying case 200 can be provided to store the pump and heater unit 28 and the dis-assembled components of the portable spa pool assembly 20. The case 200 has a hinged cover 202 to cover a container body 204. A handle 206 can extend from one end 208 of the container body 204, and a set of wheels 210 can be provided adjacent another end 212 thereof so that a user can pull the fully-loaded case 200 like pulling a piece of luggage. The container body 204 defines an interior space 214 that is large enough to fit the pump and heater unit 28, and the dis-assembled components of the portable spa pool assembly 20. The interior space 214 can even be divided into separate compartments 220 and 222 (with the divider 224 shown in phantom in FIG. 13) so that the unit 28 can be securely stored in one compartment 222, and the other components in the other compartment 220.

The assembly and operation of the portable spa pool assembly 20 will now be described. The user can unload all the dis-assembled components of the portable spa pool assembly 20 from the case 200 if the case 200 is provided. The pump and heater unit 28 can be removed from the case 200, or retained inside the case 200. The spa pool 22 is then inflated by inflating the two air chambers 72 and 76. The water inlet 30 is then coupled to the water outlet 180 of the pump and heater unit 28, and the water outlet 32 is then coupled to the water inlet 182 of the pump and heater unit 28. The strainer 90 can be fitted over the opening 88. The plumbing system is then assembled to the configuration shown in FIG. 5 or FIG. 8, by attaching the hoses 112 and 114 to the jet nozzle housings 116 in the manner described above. Thereafter, each jet nozzle housing 116 is secured to the inner wall 84 of the central groove section 74 at the locations of the connectors 166 according to the techniques illustrated in connection with FIGS. 9 and 10. The T-connector 150 is then connected to the water inlet 30, and the T-connector 152 is connected to the air control 156. At this time, the plumbing system would be secured inside the central groove section 74. The liner 24 and cover 26 can then be placed over the pool 22, in the manner shown in FIG. 2. When the liner 24 and cover 26 are placed into the interior 34 of the pool 22, the user must be careful to align the openings 40 (in the liner 24) and 62 (in the cover 26) with the jet nozzles 110. In addition, the cover 26 should not block the strainer 90 or the air control 156. The assembly is now complete, and as shown above, can be done very quickly and conveniently. Water can be filled into the interior 34 to the required water level, and the pump 186 primed by drawing water from the pool 22 into the pump 186. Since there are no obstructions between the pump 186 and the water, the water flows naturally into the pump 186 when water is filled to the desired level in the pool 22. Once the pump 186 has been primed, the pump 186 is ready to begin recirculating water. The spa pool assembly 20 is now ready for use.

To use the spa pool assembly 20, the user plugs in the power cord 194 to a power source, and then turns on the motor 184 by actuating the air button 190. Since the pump 186 has been primed, water can be drawn through the strainer 90 and opening 88 through the tubing 86 and into the pump 186. The water is then pumped through the heater 188 and via the water outlet 180 and water inlet 30 to the water hoses 114 and delivered to each jet nozzle housing 116, where the water can be ejected from each corresponding jet nozzle 110. The heater 188 is automatically turned on when water begins to circulate through the system. The water is re-circulated in the same manner.

Air bubbles can be ejected through each jet nozzle 110 due to an air pressure system. Specifically, the air control 156 is like an air inlet, and it couples the air hoses 112 to the ambient. The user can control the amount of air that enters the air control, so as to create an air pressure that is lower than the water pressure. Air is drawn from vacuum created by the high water pressure, so the lower air pressure and higher water pressure will cause air bubbles to be generated where the air meets the water in the central tubing 128 (as shown in FIG. 7), and then delivered via the jet nozzles 110 to the interior 34 of the spa pool 22.

To dis-assemble the spa pool assembly 20, the user turns off the motor 184, and disconnects all the components by reversing the steps described above. The air chambers 72 and 76 are then deflated and all the components can be stored inside the carrying case 200. During dis-assembly, it is important to note that the plumbing system can be installed into or taken out of the spa pool 22 without deflating the spa pool 22.

Figure 14:
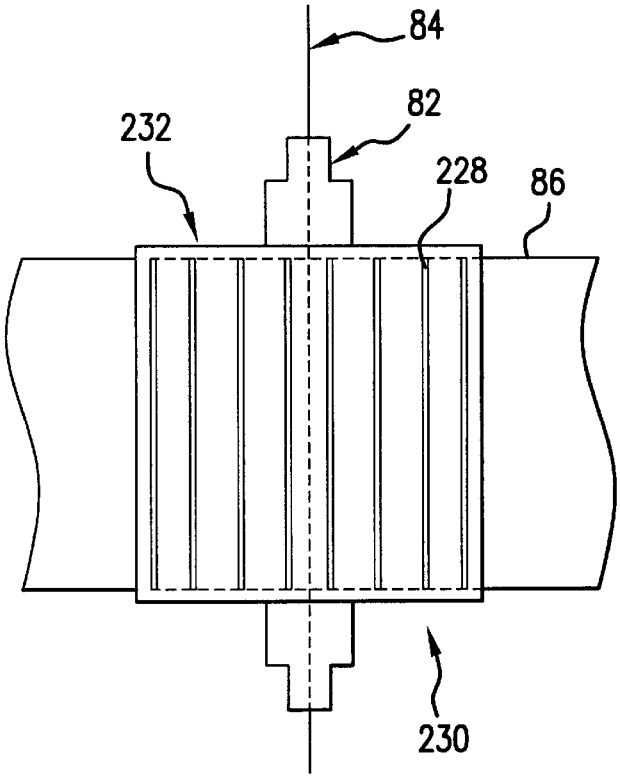
FIG. 14 is a cross-sectional view of a gasket that may be used with the spa pool assembly of FIG. 3.

The present invention also provides a unique gasket 82 that is illustrated in FIG. 14. The gasket 82 further minimizes the possibility of leakage of water from the interior 34. The gasket 82 is provided to seal and secure portions of tubing, and even though the tubing 86 is illustrated in FIG. 14, the same principles illustrated in FIG. 14 can be utilized for any of the other gaskets 82 shown in FIG. 3. The tubing 86 is preferably a hard tubing (e.g., made from hard PVC) that is injection-molded and provided with grooves or ribs 228 to provide an uneven (i.e., non-smooth) surface. The grooves or ribs 228 are positioned adjacent the inner wall 84 where leakage is most likely to occur. The gasket 82 is made from a soft material, such as soft PVC, which is then injection-molded and bonded directly over the tubing 86 on to the surface of the tubing 86. Since both the tubing 86 and the gasket 82 are made from the same material (PVC), this process creates a homogeneous bond that is essentially one material. To provide further protection against leakage, the gasket 82 can be formed with two annular side flanges 230 and 232 that extend over a greater length of the tubing 86 away from the location of the inner wall 84. The gasket 82 functions not only to prevent water leakage, but also to secure the tubing 86 at a designated location. Although PVC is used as an example for the material for the gasket 82 and the tubing 86, other materials can also be used, such as but not limited to metal, rubber or plastics.

Figure 15:
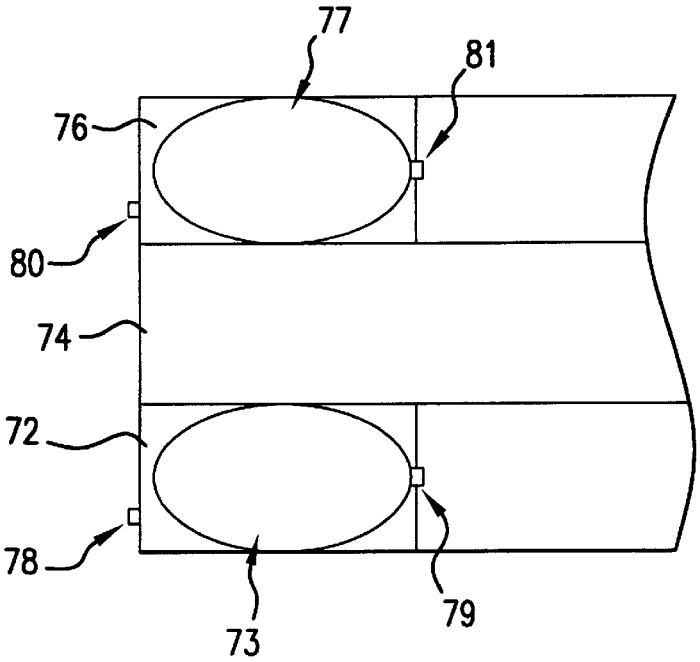
FIG. 15 is a partial cross-sectional view of the spa pool of FIG. 1 illustrating a modification thereto.

FIG. 15 illustrates a modification to the air chambers 72 and 76 that would provide further support to these chambers 72 and 76. Each air chamber 72 and 76 can be provided with an inflatable inner tube 73 and 77, respectively, to provide support and to further minimize leakage should either air chamber 72, 76 be damaged or spring a leak. Respective valves 79 and 81 extend through the air chambers 72 and 76 into the interior 34 of the pool 22, through which air can be introduced to inflate the inner tubes 73 and 77, respectively. Although the valves 79 and 81 are illustrated as extending into the interior 34 of the pool 22, it is also possible to have the valves 79, 81 extend towards the exterior of the pool 22.

As illustrated above, the spa pool assembly 20 of the present invention provides a number of benefits. First, the provision of only two openings (inlet 30 and outlet 32) between the inner wall 84 of the pool 22 and the outer wall 85 of the pool 22 minimizes the possibility of water leakage from the interior 34, when compared with other spa pools that provide more than two such openings. Second, by providing all components of the plumbing system inside the pool 22, any leakage or malfunction of the plumbing system will again minimize the possibility of water leakage outside the pool 22. Third, three layers of the wall 70, the liner 24 and the cover 26 provide three levels or layers of protection against leakage and other damage to the pool 22. Fourth, the novel gasket 82 provides an effective seal that further minimizes the possibility of water leakage. Fifth, the fact that the plumbing system can be installed into or taken out of the spa pool 22 without deflating the spa pool 22 adds to the convenience for the user, since defective parts can be easily replaced without the need to completely dis-assemble the spa pool 22. Sixth, the assembly and dis-assembly steps illustrated above are quick and easy, and do not require the use of special tools, thereby allowing the spa pool assembly 20 to be moved about for use in many different locations. Seventh, all the components in the spa pool assembly 20 are modular in that one defective part or component can be easily replaced without replacing other functioning components.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A portable spa pool, comprising:

an enclosing wall defining an interior, the wall having at least one inflatable chamber; and a plumbing system retained in the interior and against the wall, the plumbing system including a plurality of jet nozzles, and a plurality of hoses that couple the plurality of jet nozzles;

wherein the at least one inflatable chamber has a first inflatable chamber and a second inflatable chamber that define a groove therebetween, with the plurality of jet nozzles and the plurality of hoses secured in the groove.

2. The pool of claim 1, further including a liner overlying the first and second inflatable chambers and the groove, the liner having a plurality of openings, each of which is aligned with a separate jet nozzle.

3. The pool of claim 1 wherein the hoses include a plurality of air hoses and a plurality of water hoses.

4. The pool of claim 1, further including exactly two openings that communicate the interior with the exterior of the pool, the two openings including a first opening coupled to an inlet for receiving water into the interior from a pump, and a second opening coupled to an outlet for delivering water from the interior to a pump, the first opening coupled to one of the hoses.

5. The pool of claim 4, further including a drainage outlet coupled to the outlet for draining water from the interior.

6. The pool of claim 1, further including a plurality of jet nozzle housings, each jet nozzle housing retaining a separate jet nozzle and having a T-connector for connecting adjacent hoses.

7. The pool of claim 6, further including a connector for connecting each jet nozzle housing to the enclosing wall.

8. A portable spa pool, comprising:

an enclosing wall defining an interior, the wall having at least one inflatable chamber and exactly two openings that communicate the interior with the exterior of the spa pool, the two openings including a first opening coupled to an inlet for receiving water into the interior from a pump, and a second opening coupled to an outlet for delivering water from the interior to a pump; and a plumbing system retained in the interior and against the wall, the plumbing system including a plurality of jet nozzles, and a plurality of water hoses and air hoses that couple the plurality of jet nozzles;

wherein the at least one inflatable chamber has a first inflatable chamber and a second inflatable chamber that define a groove therebetween, with the plurality of jet nozzles and the plurality of hoses secured in the groove.

9. The pool of claim 8, further including a liner overlying the first and second inflatable chambers and the groove, the liner having a plurality of openings, each of which is aligned with a separate jet nozzle.

10. The pool of claim 8, further including a plurality of jet nozzle housings, each jet nozzle housing retaining a separate jet nozzle and having a T-connector for connecting adjacent hoses.

11. The pool of claim 10, further including a connector for connecting each jet nozzle housing to the enclosing wall.

12. The pool of claim 8, further including a drainage outlet coupled to the outlet for draining water from the interior.

* * * * *